US008478459B2

(12) United States Patent
Mutuel et al.

(10) Patent No.: US 8,478,459 B2
(45) Date of Patent: Jul. 2, 2013

(54) SYSTEM AND METHOD FOR DETECTING WAKE TURBULENCE OF AN AIRCRAFT

(75) Inventors: Laurence Mutuel, Tournefeuille (FR); Bertrand Baillon, Saubens (FR)

(73) Assignee: Thales, Neuilly sur Seine (FR)

( * ) Notice: Subject to any disclaimer, the term of this patent is extended or adjusted under 35 U.S.C. 154(b) by 0 days.

(21) Appl. No.: 13/071,756

(22) Filed: Mar. 25, 2011

(65) Prior Publication Data

US 2011/0282524 A1 Nov. 17, 2011

(30) Foreign Application Priority Data

Mar. 26, 2010 (FR) ..... 10 01227

(51) Int. Cl.
*G08G 5/00* (2006.01)

(52) U.S. Cl.
CPC ..... *G08G 5/0091* (2013.01); *G08G 5/0008* (2013.01); *G08G 5/0021* (2013.01); *G08G 5/0078* (2013.01)
USPC ..... 701/14; 701/9

(58) Field of Classification Search
CPC ... G08G 5/0008; G08G 5/0021; G08G 5/0078; G08G 5/0091
USPC ..... 701/9, 14; 340/963, 968
IPC ..... G08B 23/00
See application file for complete search history.

(56) References Cited

U.S. PATENT DOCUMENTS

| | | | | |
|---|---|---|---|---|
| 5,845,874 | A | 12/1998 | Beasley et al. | |
| 6,177,888 | B1 | 1/2001 | Cabot et al. | |
| 6,963,291 | B2 * | 11/2005 | Holforty et al. | 340/945 |
| 7,411,519 | B1 | 8/2008 | Kuntman et al. | |
| 2007/0103340 | A1 | 5/2007 | Baranov et al. | |
| 2008/0030375 | A1 * | 2/2008 | Cotton et al. | 340/945 |
| 2008/0035784 | A1 * | 2/2008 | Meserole et al. | 244/3.1 |

FOREIGN PATENT DOCUMENTS

| | | | |
|---|---|---|---|
| FR | 2899350 | A1 | 10/2007 |
| WO | 2007115359 | A1 | 10/2007 |
| WO | 2008002675 | A2 | 1/2008 |

OTHER PUBLICATIONS

Bilanin et al. "Feasibility of an Onboard Wake Vortex Avoidance System", NASA Langley Research Center, Hampton, VA, Report No. CDI-87-02, Apr. 1987.*

Holzäpfel. "Probabilistic Two-Phase Aircraft Wake-Vortex Model: Further Development and Assessment", Journal of Aircraft, vol. 43 No. 3, May 2006, pp. 700-708.*

Steen et al. "Collaboration of Wake Vortex Models and Sensors in Modern Avionic Systems," IEEE/AIAA 28th Digital Avionics Systems Conference, Oct. 2009, pp. 1.C.1-1-1.C.1-9.*

King. "Inertial Navigation-Forty Years of Evolution." GEC Review, vol. 13 No. 3, 1998, pp. 140-149.*

French Search Report from FR 1001227, issued Nov. 24, 2010.

* cited by examiner

*Primary Examiner* — James Trammell
*Assistant Examiner* — Todd Melton
(74) *Attorney, Agent, or Firm* — Stroock & Stroock & Lavan LLP

(57) ABSTRACT

System for detecting wake turbulence (SDWT) of a first aircraft, which can be embedded onboard a second aircraft, comprising:

Figure 1:
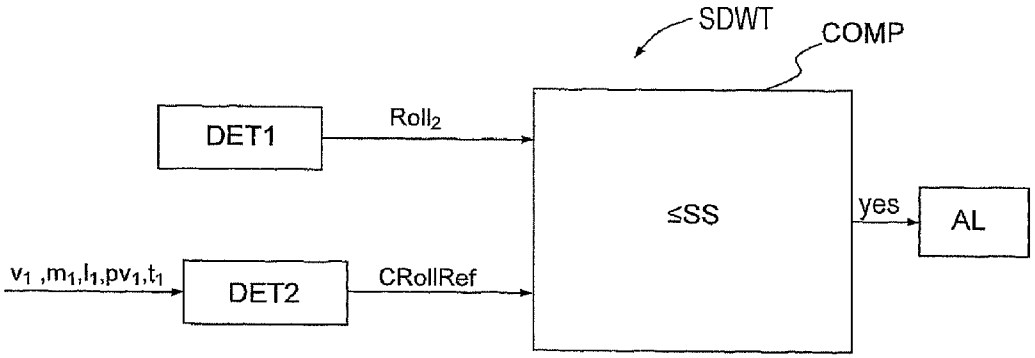

first means (DET1) for determining the roll ($Roll_2$) of the second aircraft;

second determination means (DET2) of an envelope (CRollRef) of reference roll curves which is representative of a wake turbulence created by the first aircraft;

means (COMP) for comparing, over a sliding window, the roll ($Roll_2$) of the second aircraft and the envelope (CRollRef) of reference roll curves; and alarm means (AL) for forewarning the pilot of the second aircraft of the detection of wake turbulence of the first aircraft when the said comparison is below a resemblance threshold (SS).

10 Claims, 2 Drawing Sheets

SYSTEM AND METHOD FOR DETECTING WAKE TURBULENCE OF AN AIRCRAFT

This application claims priority to French Patent Application No. 1001227, filed Mar. 26, 2010, the contents of which are incorporated herein.

The invention pertains to a system and a method for detecting wake turbulence of an aircraft.

Wake turbulence is aerodynamic turbulence which forms behind an aircraft. This turbulence comprises the phenomena of jetwash and of wingtip vortices.

Jetwash is due to the gases expelled by the jet engines of an aircraft, and is an extremely violent, but short-duration, phenomenon. Conversely, a wingtip vortex corresponds to turbulence at the extremities of the wings and on their upper surface. It is less violent, but can endure for several minutes after an aircraft passes, and is thus an insidious cause of aircraft accidents.

Wake turbulence increases the drag of an aircraft and is particularly dangerous for another aircraft situated behind in a takeoff phase or in a landing phase for several reasons:

- in these phases, the speed of the aircraft is low and its angle of attack high, thereby favouring the occurrence of such turbulence;
- in these phases, the aircraft is at low speed close to stall and close to the ground, also it has a small margin for manoeuvre in case of an incident; and
- aircraft glide paths are denser in proximity to aerodromes.

On takeoff and landing, wake turbulence extends towards the rear of the craft, but also around the runway when the atmosphere is calm, for example when there is little wind or little turbulence. When the wind is blowing across the runways, it carries this turbulence off to one side of the runway, so that it may reach a neighbouring or parallel runway and be dangerous.

Wake turbulence is therefore also particularly uncomfortable for the passengers of the aircraft.

Currently, only the aircraft pilot's experience makes it possible to get out of the grip of wake turbulence and prevention consists in allowing for sufficient separation distances between two successive aircraft such that wake turbulence created by an aircraft no longer poses a danger to a following aircraft.

With the appearance of wide-bodied aircraft of very large size, the densification of traffic and demands to reduce separation distances, the risk of an aircraft experiencing wake turbulence is ever higher.

An aim of the invention is to limit the risk of an aircraft pilot being surprised by wake turbulence and having an inappropriate reaction.

According to one aspect of the invention, there is proposed a system for detecting wake turbulence of a first aircraft, which can be embedded onboard a second aircraft. The system comprises:

- first means for determining the roll of the second aircraft;
- second means for determining an envelope of reference roll curves which is representative of a wake turbulence created by the first aircraft;
- means for comparing, over a sliding window, the roll of the second aircraft and the envelope of reference roll curves; and
- alarm means for forewarning the pilot of the second aircraft of the detection of wake turbulence of the first aircraft when the said comparison is below a resemblance threshold.

Such a system makes it possible to alert a pilot before he himself becomes aware of the presence of wake turbulence, this possibly allowing him to immediately apply appropriate procedures to avoid a worsening of the situation.

An envelope of reference roll curves is defined for the second aircraft, said envelope being representative of the effect on its attitude of wake turbulence created by the first aircraft, as a sinusoid period of the roll angle function. The envelope is obtained by varying the characteristics of the first aircraft (speed, mass, wingspan, etc.) by simulation or by in-flight trials.

In one embodiment, the second determination means comprise first inputs comprising operating parameters of the said first aircraft.

For example, the said first inputs comprise the speed of the first aircraft, and/or the mass of the first aircraft, and/or the wingspan of the first aircraft, and/or the flight phase of the first aircraft, and/or the type of the said first aircraft, so as to determine the said envelope of reference roll curves.

These data are already determined by an aircraft, and may be transmitted to the other aircraft, either directly by the aircraft, or in a manner relayed by a ground station.

According to one embodiment, the first means for determining the roll of the second aircraft comprise an inertial platform.

Aircraft are already obliged to possess an inertial platform which measures the roll variations which make it possible to calculate the roll or angle of roll. Several models thereof of different accuracy and reliability exist, but as the error of an inertial platform is known, the quality of the latter in no way changes the calculations implemented in the system.

In one embodiment, the comparison means are adapted for comparing, over the sliding window, the said roll of the second aircraft and the said envelope of reference roll curves, by comparing a function applied to the said roll and the said function applied to the said envelope of reference roll curves.

It is indeed possible to apply a function to the angle of roll in such a way as to improve the accuracy of detection, and to limit false detections or missed detections.

The said function applied can comprise Gaussians.

Statistical processing such as this makes it possible to qualify the detection rate and to refine the parameters of the function so as to achieve the false detection or missed detection rate that is satisfactory for the user.

For example, the said envelope of reference roll curves comprises curves arising from the wake turbulence models of P2P, APA or WAKE4D type.

According to one embodiment, the second determination means comprise, furthermore, second inputs comprising external parameters of the first aircraft.

For example, the said second inputs comprise the position of the first aircraft, the wind in the space separating the first and second aircraft, and/or the temperature in the space separating the first and second aircraft, so as to determine the said envelope of reference roll curves.

Thus, the accuracy of detection is further improved.

According to another aspect of the invention, there is also proposed an aircraft equipped with a system according to one of the preceding claims.

According to another aspect of the invention, there is also proposed a method for detecting wake turbulence of a first aircraft, experienced by a second aircraft, in which:

- the roll of the second aircraft is determined;
- an envelope of reference roll curves which is representative of a wake turbulence created by the first aircraft is determined;
- the roll of the second aircraft and the envelope of reference roll curves are compared over a sliding window; and the pilot of the second aircraft is alerted of the detection of wake turbulence of the first aircraft when the said comparison is below a resemblance threshold.

Figure 2:
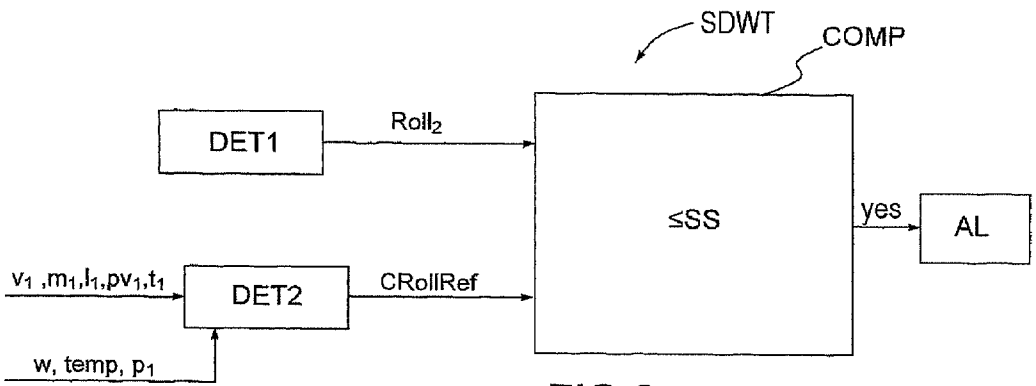
Figure 3:
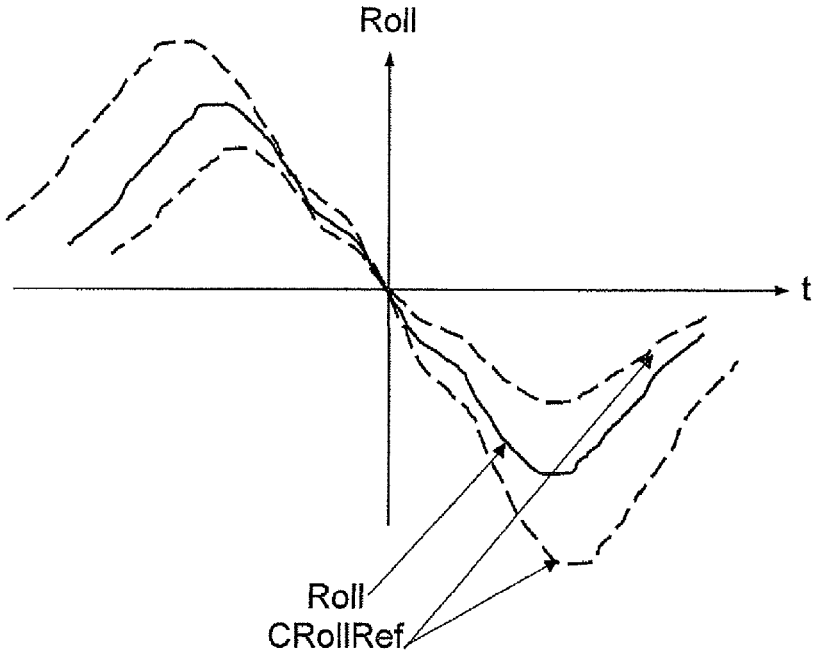

The invention will be better understood on studying a few embodiments described by way of wholly non-limiting examples and illustrated by the appended drawings in which:

FIG. 1 schematically illustrates a system for detecting wake turbulence, according to one aspect of the invention;

FIG. 2 schematically illustrates a system for detecting wake turbulence, according to another aspect of the invention; and FIG. 3 schematically represents the comparison between the roll of the second aircraft and the envelope of reference roll curves, according to one aspect of the invention.

In the various figures, the elements having identical references are similar.

In FIG. 1 is represented a system for detecting wake turbulence SDWT of a first aircraft, which can be embedded onboard a second aircraft.

The system SDWT comprises a first module DET1 for determining the angle of roll, also named simply roll $Roll_2$, of the second aircraft, onboard which the system for detecting wake turbulence SDWT is embedded. The system also comprises a second module DET2 for determining an envelope CRollRef of reference roll curves which is representative of a wake turbulence created by the first aircraft, such as is represented in FIG. 3, and a module COMP for comparing, over a sliding window, the roll of the second aircraft and the envelope CRollRef of reference roll curves.

The transmission of parameters from the first aeroplane by the determination means DET2 by data link to the second aeroplane, DET2 is generated on the basis of this information provided as input to a wake turbulence model, or DET2 can be extracted from an onboard database of these curves with as search key the information about the first aircraft originating from the onboard monitoring.

The comparison module COMP, as specified hereinafter, may be effected by sliding a window over the reference roll curve until a verisimilitude is found between the roll sinusoids (for example on the first derivatives) or by correlation.

An alarm module AL makes it possible to forewarn the pilot of the second aircraft of the detection of wake turbulence generated by the of the first aircraft when the said comparison performed by the comparison module COMP is below or equal to a resemblance threshold SS.

The resemblance threshold can, for example, be a constant value for a comparison in the sliding window, or of a statistical nature such as a Gaussian extracted from the values for the second aircraft, compared with the reference Gaussian by a correlation function of $x^2$ type.

The envelope CRollRef of reference roll curves may be formulated on the basis of a databank of signatures obtained on the basis of measurement campaigns (for example measurement campaigns in airports performed since the year 1990). A signature is understood as values taken by a set of representative parameters, in this instance a roll curve. These signatures are associated with particular aircraft for a certain range of speeds and in a particular flight phase or configuration for example an approach. The generic signature model is extracted by considering the variability of the speed range, the impact of the aeroplane configuration and the weight variation, these being the main parameters influencing the reference roll curves.

The envelope of reference roll curves may be obtained by simulation: once the signature of the turbulence-generating aeroplane has been captured, the "air" parameters in the presence of turbulence (air speed, accelerations) are overlaid on the stable "air" parameters input to the equations for the dynamics of the second aircraft. The roll variation curve is recorded as output.

As a variant, the envelope of reference roll curves may be obtained by in-flight trials: the roll curve of the second aircraft is recorded, for example on the information of the inertial platforms, after passing through the wake turbulence of the first aircraft. The wake turbulence of the first aircraft is simultaneously recorded by ground sensors (lidar, radar, multilateration, etc.).

For a new carrier or a carrier that has not been measured during campaigns or that cannot join in a campaign or fly over a suitably equipped airport, the generic signature may be obtained by processing the ranges of variability (speed, weight, configuration) with an approved vortex wake model (to date there are 3 such: P2P, APA and WAKE4D).

The second determination module DET2 comprises first inputs comprising operating parameters of the first aircraft. The first inputs can comprise, for example, the speed $v_1$ of the first aircraft, and/or the mass $m_1$ of the first aircraft, and/or the wingspan $l_1$ of the first aircraft, and/or the flight phase $pv_1$ of the first aircraft, and/or the type $t_1$ of the said first aircraft, so as to determine the said envelope CRollRef of reference roll curves.

The first determination module MOD1 comprises, in this instance, an inertial platform. Aircraft are already obliged to possess an inertial platform, which measures the variations in the angle of roll of the aircraft which make it possible to calculate the roll or angle of roll, by temporal integration. Several models thereof of different accuracy and reliability exist, but as the error of an inertial platform is known, the quality of the latter in no way changes the calculations implemented in the system.

The comparison means COMP are adapted for comparing, over the sliding window, the roll $Roll_2$ of the second aircraft and the said envelope CRollRef of reference roll curves, by comparing a function applied to the said roll and this same function applied to the said envelope of reference roll curves.

This function can, for example, take account of the variation in intensity over a representative interval, take account of the roll inversion time either on passing the optimum or on a change of sign. In addition, this function can for example be the temporal derivative of the roll function.

The roll signature when the second aircraft experiences the wake turbulence of the first aircraft is similar to a sinusoid period with specific characteristics on the slopes, the amplitude and the period of each half-period of the curve. These specific features are so many points to be correlated.

The envelope CRollRef of reference roll curves can, for example be determined using curves arising from the wake turbulence models of P2P, APA or WAKE4D type, to which variations of inputs are applied so as to establish a fan of curves, from which the envelope is extracted.

In FIG. 2 is illustrated a variant of the embodiment of the system of FIG. 1, in which the second determination module DET2 comprises, furthermore, second inputs comprising external parameters of the first aircraft. In this instance, the second inputs comprise, for example, the position of the first aircraft, the wind in the space separating the first and second aircraft, and/or the temperature in the space separating the first and second aircraft, so as to determine the said envelope of reference roll curves.

These additional parameters make it possible to add an anticipation of the alerts, by replacing estimations with measurements, and thus reduce the variability of the envelope established by the first variant embodiment, thereby directly reducing the rate of false alerts and of missed alerts.

The invention makes it possible to inform the pilot of an aircraft so that he can take steps, for example by applying a predefined procedure, so as to avoid worsening the situation.

What is claimed is:

1. A system for detecting wake turbulence of a first aircraft, which is configured to be embedded onboard a second aircraft, comprising:

first means for determining roll of the second aircraft;

second means for determining an envelope of reference roll curves which is representative of a wake turbulence created by the first aircraft;

means for comparing, over a sliding window, the roll of the second aircraft and the envelope of reference roll curves; and alarm means for forewarning a pilot of the second aircraft of detection of wake turbulence of the first aircraft when said comparison is below a resemblance threshold.

2. The system according to claim 1, wherein the second means for determining the envelope of reference roll curves comprises first inputs comprising operating parameters of said first aircraft.

3. The system according to claim 2, wherein said first inputs comprise a speed of the first aircraft, a mass of the first aircraft, a wingspan of the first aircraft, a flight phase of the first aircraft, or a type of said first aircraft, so as to determine said envelope of reference roll curves.

4. The system according to claim 1, wherein the first means for determining the roll of the second aircraft comprises an inertial platform.

5. The system according to claim 1, wherein the means for comparing is adapted for comparing, over the sliding window, said roll of the second aircraft and said envelope of reference roll curves, by comparing a function applied to said roll and said function applied to said envelope of reference roll curves.

6. The system according to claim 5, wherein said function comprises Gaussians.

7. The system according to claim 1, wherein said envelope of reference roll curves comprises curves of P2P, APA or WAKE4D type.

8. The system according to claim 1, wherein the second determination means further comprises, second inputs comprising external parameters of the first aircraft.

9. The system according to claim 8, wherein said second inputs comprise a position of the first aircraft, a wind in a space separating the first and second aircraft, or a temperature in the space separating the first and second aircraft, to determine said envelope of reference roll curves.

10. A method for detecting wake turbulence of a first aircraft, experienced by a second aircraft, the method using a processor and comprising:

determining roll of the second aircraft;

determining an envelope of reference roll curves which is representative of a wake turbulence created by the first aircraft;

comparing the roll of the second aircraft and the envelope of reference roll curves over a sliding window; and alerting a pilot of the second aircraft of a detection of wake turbulence of the first aircraft when said comparison is below a resemblance threshold.

* * * * *